US005518341A

United States Patent [19]

Verret

[11] Patent Number: 5,518,341

[45] Date of Patent: May 21, 1996

[54] PRODUCTION FLUID ASSEMBLY FOR REMOTE OFFSHORE FACILITIES STORAGE

[75] Inventor: Allen J. Verret, Abita Springs, La.

[73] Assignee: Texaco Inc., White Plains, N.Y.

[21] Appl. No.: 300,886

[22] Filed: Sep. 6, 1994

[51] Int. Cl.[6] ..... B65D 88/78

[52] U.S. Cl. ..... 405/210; 220/501; 220/506; 405/59

[58] Field of Search ..... 405/53, 59, 195.1, 405/210; 137/571, 572, 576, 577; 220/501, 506

[56] References Cited

U.S. PATENT DOCUMENTS

| | | | |
|---|---|---|---|
| 2,747,774 | 5/1956 | Breitenbach | 405/59 X |
| 3,425,791 | 2/1969 | Koberg | 405/210 X |
| 3,605,774 | 9/1971 | Launay et al. | 405/210 X |
| 3,837,310 | 9/1974 | Toyama | 405/210 X |
| 3,855,809 | 12/1974 | Westling | 405/210 |
| 3,858,402 | 1/1975 | Baker et al. | 405/210 |
| 4,230,422 | 10/1980 | Brown et al. | 405/210 |
| 5,366,322 | 11/1994 | Hurwitt | 405/210 X |

FOREIGN PATENT DOCUMENTS

| | | | |
|---|---|---|---|
| 131115 | 10/1979 | Japan | 405/210 |

*Primary Examiner*—Eric K. Nicholson
*Assistant Examiner*—John A. Ricci
*Attorney, Agent, or Firm*—Kenneth R. Priem; James L. Bailey; William J. Beard

[57] ABSTRACT

The present invention concerns a system for providing storage for hydrocarbons produced at an offshore production facility. A tank assembly having inner and outer tanks defining an annular chamber therebetween and the inner tank defining an inner chamber, has a piling projection extending from one end thereof. A first piping system is connected to the annular chamber and input piping system connected to the inner chamber and an output piping system connected to the inner chamber. The outer chamber is flooded to provide ballast for the system during and after placement of the piling into the soil beneath a platform.

4 Claims, 2 Drawing Sheets

PRODUCTION FLUID ASSEMBLY FOR REMOTE OFFSHORE FACILITIES STORAGE

BACKGROUND OF THE INVENTION

1. The Field of the Invention

The present invention relates to a method and apparatus for providing temporary storage of produced fluids at a remote off-shore hydrocarbon production facility.

2. The Prior Art

There are many problems associated with off-shore production of hydrocarbons. Among these problems is what to do with the produced fluids. If the facility is not too remote it may be connected with a pipeline system which can convey the produced fluid to a near by collection point and/or to an on-shore facility for subsequent processing. If the facility is located in a region of a number of like facilities, it may be convenient to convey the fluid to a common pick-up point where a floating collector gathers and transports the produced hydrocarbons. The case of a remote facility that is substantially isolated produces a number of problems in what to do with the produced fluids.

On site storage facilities have a number of inherent problems. For example, storage above-surface would have the problems of providing sufficient volume to be useful and to be environmentally secure. A subsurface facility would have similar problems of providing a secure storage for the fluids and non-contamination of the environment and to be substantially stable against motion from the waves and water.

The present invention overcomes many of the problems of the prior art by providing a storage apparatus which can be either built into an off-shore rig or retrofitted onto an existing rig to provide the desired amount of on-site storage.

SUMMARY OF THE INVENTION

The present invention concerns a hydrocarbon storage system for use providing additional storage in off-shore locations. The invention is a storage tank/piling assembly. The storage tank portion of the assembly is formed by a pair of concentric tanks defining inner axial and outer annular chambers. Piling means are fixed to one end of the tank assembly and fluid connection and communication means are connected to the opposite end. The storage tank/piling assembly is roughly positioned with respect to the off shore platform and the outer chamber flooded to ballast the assembly which can then be driven or jetted into place in proximity to the existing platform.

BRIEF DESCRIPTION OF THE DRAWINGS

The present invention will now be described, by way of example, with reference to the accompanying drawings wherein.

DETAILED DESCRIPTION OF THE PREFERRED EMBODIMENT

Figure 1:
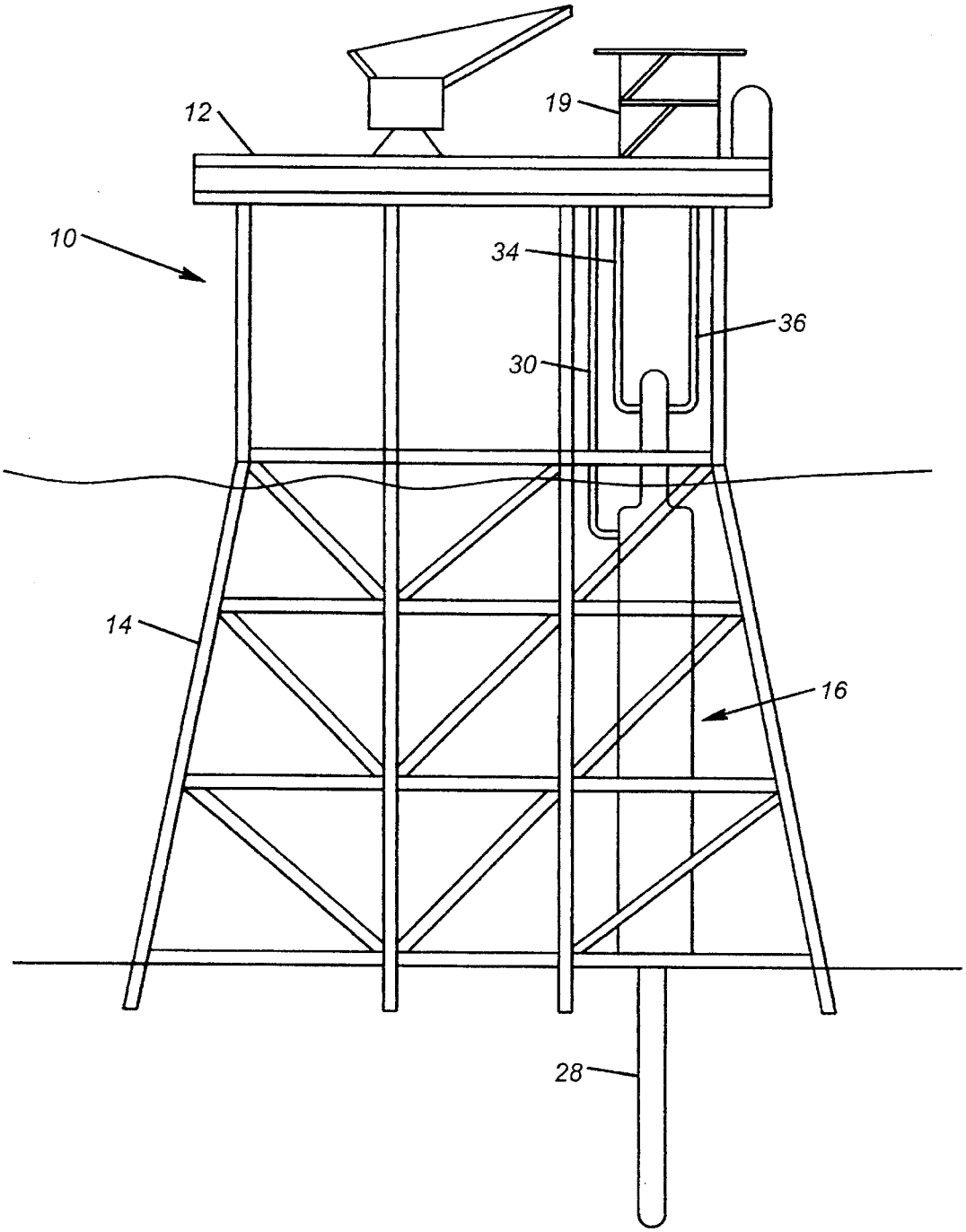
FIG. 1 is a schematic side elevation of a off-shore production platform with the subject invention in place.

FIG. 1 shows a typical off-shore production facility 10 having a platform 12 supported above the ocean surface by a plurality of legs 14. One or more wells (not shown) are sunk into the soil surface and produce hydrocarbons to the vicinity of the platform. The present invention 16 is shown as it would be positioned to collect and store the hydrocarbon production until such time as it can be subsequently collected and carried off-site.

Figure 2:
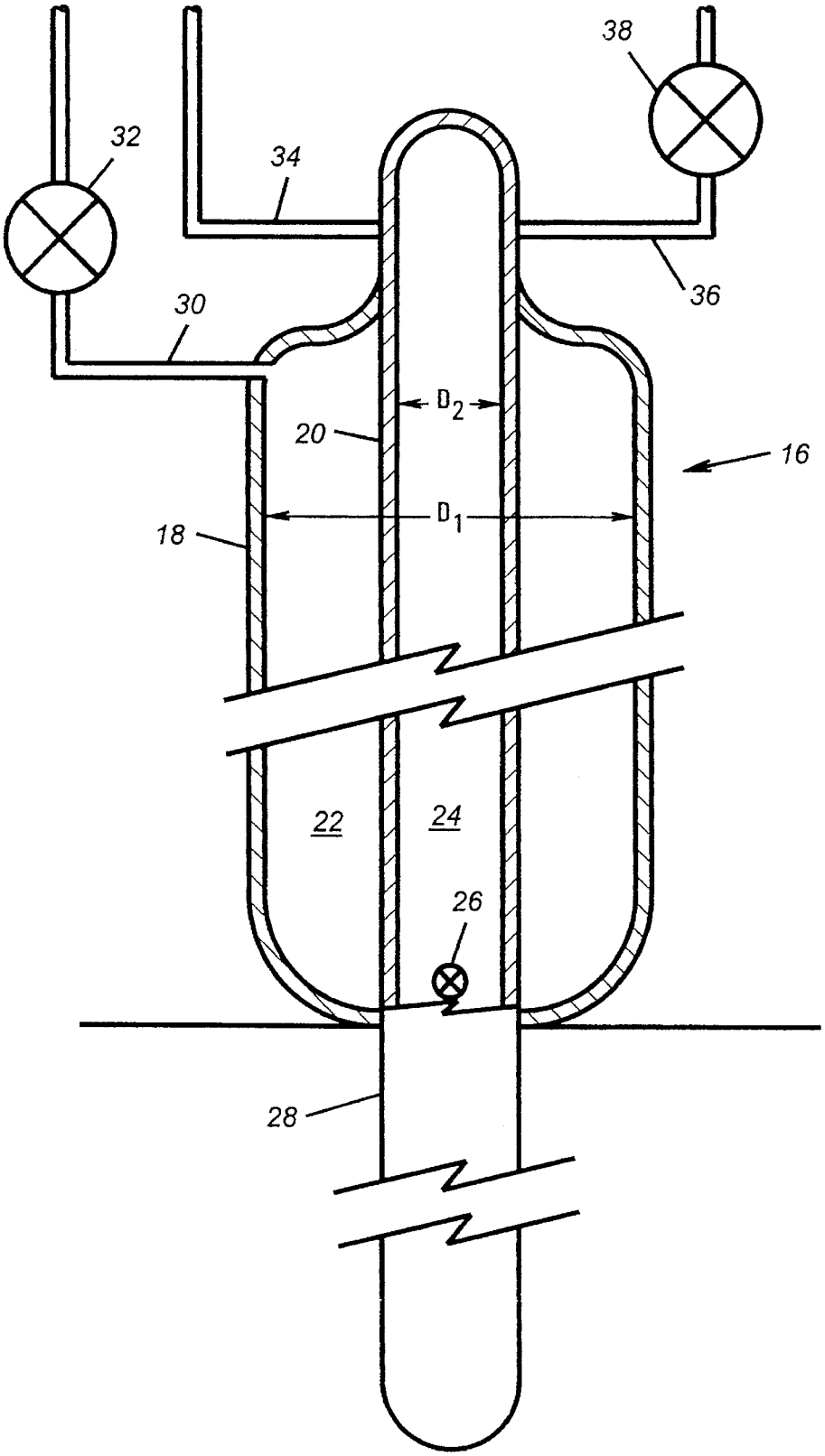
FIG. 2 is a detailed side elevation, partly in section, of the present invention.

Turning now to FIG. 2, the invention 16 is shown in somewhat greater detail. The storage facility 16 according to the present invention has a first or outer tank 18 having a diameter $D_1$ and an inner tank 20 coaxial with the outer tank 18 and having a smaller diameter $D_2$. An annular outer chamber 22 is formed between the outer and inner tanks and an inner axial chamber 24 is formed within the inner tank. A valve 26 interconnects the chambers. One end of the assembly, which is to become the lower end, is formed into a piling 28. The opposite end of the assembly is provided with a plurality of fluid transfer means. These include ballasting conduit 30 connected to the outer annular chamber 22 and provided with valve means 32, a production inlet conduit 34 connected to the inner axial chamber 24 and by means (not shown) to the actual production facility; and an output conduit 36 connected to the inner axial chamber 24 and having valve means 38 therein to control removal of the stored hydrocarbon from the subject storage tank.

The inner tank/piling is fabricated in accordance with normal roll procedures and is built in lengths compatible to installation capabilities. The material for the inner tank/piling is selected for sufficient strength to withstand driving or jetting into place on site. The outer tank can be constructed from somewhat lighter materials. If possible, the tank assembly 16 is built to its total length and loaded out to the site on its side, transported via a barge, and placed into position via a side launch cradle. Once at site and up-righted, by selective ballasting, the tank assembly is lowered into position until the piling end makes contact with the soil. The tank assembly 16 is then driven or jetted into its design location and braced back to the platform via known clamp braces (not shown). Once in place all the vertical load is transmitted to the soil and all horizontal loads, caused by environmental conditions, are transmitted to the platform.

Piping for both the brine ballasting and hydrocarbon storage and off-loading is tied in the system and can be tested for integrity. Once the piping and tank have been tested, the interior of the inner tank piling is filled with brine until the outer tank achieves a suitable level. Transfer of the brine is accomplished via a shutoff valve 26 located near the bottom of the outer tank 18.

Hydrocarbons can now be pumped into the inner chamber 24, and will force the brine from the inner chamber into the outer chamber 22. Actual levels can be monitored by the pressures required to balance the fluid. A suitable surface tank 19, for storage of brine, is kept on the production deck. The brine is injected down piping run 30 when it is necessary to off-load the stored hydrocarbon. By shutting a valve (not shown) on line 34 and open the valve 38 on line 36, brine can be pumped to displace the stored hydrocarbon via line 36 to either a barge or a pipeline system. Once the stored hydrocarbon is displaced, the valve 38 is shut and the system can be left to equalize. New production is pumped in via line 34 displacing the brine via line 30 to surface storage 19.

The present invention may be subject to many modifications and changes without departing from the spirit or essential characteristics thereof. The present embodiment should therefore be considered in all respects as illustrative and not restrictive as to the scope of the invention.

What is claimed is:

1. A storage system providing additional on-site storage for fluids produced at an offshore hydrocarbon production facility, said system comprising:

storage tank means adapted to be mounted sub-sea adjacent said production facility, said storage tank means having an elongated inner tank and an outer tank mounted substantially coaxially on at least a portion of said inner tank forming an annular outer chamber therebetween, said inner tank defining an axial inner chamber;

a ballast fluid storage tank;

valve means between said inner and outer chambers;

piling means forming a first end of said tank means;

ballasting piping means connected to said ballast fluid storage tank and to said annular outer chamber;

production input piping means connected to said inner axial chamber; and production output piping means connected to said inner chamber whereby ballasting fluid is flowed from said ballast fluid storage tank into said annular chamber and through said valve means to said inner chamber to submerge said storage tank means and said piling means is set into the earth to fix said system in place, and production fluid is flowed into said axial chamber displacing said ballasting fluid into said annular chamber via said valve means to create a pressure head which, when said input piping is closed and said outlet piping is opened, will drive the produced fluid from said storage tank means.

2. A storage system according to claim 1 wherein said inner tank extends beyond one end of said outer tank to form said piling means.

3. A storage system according to claim 2 wherein at least said piling means portion of said inner tank is formed of material sufficiently strong to withstand being driven into the ground subsurface.

4. A method for providing added fluid storage for hydrocarbons produced at an offshore production facility, said method comprising the steps of:

providing a ballast fluid storage tank;

providing storage tank means having an axial chamber and a concentric annular chamber and an interconnecting valve;

providing piling means at one end of said storage tank means;

positioning said tank substantially vertically disposed adjacent an offshore production facility by inserting said piling into the ground;

connecting ballasting piping to said ballast fluid storage tank and to said annular chamber;

connecting production input piping to said axial chamber;

connecting production output piping to said axial chamber;

flowing ballasting fluid from said ballast fluid storage tank into said annular chamber, and allowing said ballasting fluid to flow into said axial chamber through said interconnecting valve;

pumping production fluids into said axial chamber to displace at least a portion of said ballasting fluid into said annular chamber via said interconnecting valve and thereby create a pressure head; and closing said input piping and opening said output production piping whereby produced fluids will be driven out of said axial chamber.

* * * * *